US005199223A

United States Patent [19]

Rudolf et al.

[11] Patent Number: 5,199,223

[45] Date of Patent: Apr. 6, 1993

[54] DEVICE FOR CLAMPING A DISC-SHAPED TOOL

[75] Inventors: Boris Rudolf, Stuttgart; Josef Gentischer, Weinstadt, both of Fed. Rep. of Germany

[73] Assignee: C. & E. Fein GmbH & Co., Stuttgart, Fed. Rep. of Germany

[21] Appl. No.: 465,639

[22] Filed: Jan. 22, 1990

Related U.S. Application Data

[63] Continuation of Ser. No. 293,299, Jan. 4, 1989, abandoned.

[30] Foreign Application Priority Data

Jan. 9, 1988 [DE] Fed. Rep. of Germany ..... 3800437

[51] Int. Cl.[5] ..... B24B 23/02

[52] U.S. Cl. ..... 51/168; 83/666

[58] Field of Search ..... 51/168, 170 R, 170 PT, 51/170 T, 322; 83/666

[56] References Cited

U.S. PATENT DOCUMENTS

| | | | |
|---|---|---|---|
| 3,691,900 | 9/1972 | Novak et al. | 90/11 A |
| 4,597,227 | 7/1986 | Gentischer | 51/168 |
| 4,677,792 | 7/1987 | Speidel | 51/168 |
| 4,779,382 | 10/1988 | Rudolf | 51/168 |
| 4,941,292 | 7/1990 | Rudolf | 51/168 |

FOREIGN PATENT DOCUMENTS

| | | |
|---|---|---|
| 0253181 | 6/1987 | European Pat. Off. . |
| 1062567 | 1/1960 | Fed. Rep. of Germany . |
| 1824252 | 12/1960 | Fed. Rep. of Germany . |
| 6918532 | 5/1969 | Fed. Rep. of Germany . |
| 1552683 | 4/1970 | Fed. Rep. of Germany . |
| 2358399 | 4/1975 | Fed. Rep. of Germany . |
| 496431 | 4/1970 | Japan . |
| 1094072 | 12/1967 | United Kingdom . |
| 2074056 | 4/1980 | United Kingdom . |
| 2071567 | 9/1981 | United Kingdom . |

*Primary Examiner*—M. Rachuba
*Attorney, Agent, or Firm*—Kramer, Brufsky & Cifelli

[57] ABSTRACT

A compact device for clamping a disc-shaped tool on a tool spindle of a portable machine tool with a clamping anchor arranged in the tool spindle, with a clamping flange attachable to the free end of the clamping anchor, with an abutment arranged at the tool end of the tool spindle and with a manual actuating mechanism for releasably pressing the clamping flange against the abutment, thereby clamping the tool between the clamping anchor and the tool spindle. The manual actuating mechanism includes a first pressure cylinder having a first cavity and a second pressure cylinder having a second cavity, and a connecting channel between the cavities. The second pressure cylinder includes a piston delimiting the second cavity. The piston is adjustable and fixable by the manual actuating mechanism from the tool end of the tool spindle for releasably clamping the tool on the tool spindle.

31 Claims, 3 Drawing Sheets

DEVICE FOR CLAMPING A DISC-SHAPED TOOL

CROSS-REFERENCE TO RELATED APPLICATIONS

This application is a continuation of copending, commonly-owned U.S. patent application Ser. No. 293,299, entitled "DEVICE FOR CLAMPING A DISC-SHAPED TOOL", filed Jan. 4, 1989, now abandoned.

BACKGROUND OF THE INVENTION

The invention relates to a device for clamping a disc-shaped tool on a motor-driven tool spindle of a portable machine tool, in particular, a grinding disc on an angle grinder, with a clamping anchor arranged in the tool spindle which has an axial recess, the clamping anchor being axially displaceable relative to the tool spindle and rotationally fixedly connected to the tool spindle, with a clamping flange which is releasable attachable to the free end of the clamping anchor, with an abutment arranged at the tool end of the tool spindle and with a means actuatable by a manual actuating mechanism for releasably pressing the clamping flange against the abutment, thereby clamping the tool between these.

Such a device is known from German Patent 3 405 885. Herein, the clamping anchor arranged in the tool spindle in the form of a hollow spindle is pushed by a pressure spring similarly arranged in the tool spindle so that a clamping flange attachable to the clamping anchor clamps the disc-shaped tool against an abutment on the tool spindle. Therefore, in this device, the clamping force is generated by a spring arranged in the hollow spindle. The clamping anchor can be pushed against the force of the pressure spring by the actuating mechanism so that the clamping flange can be easily released or untightened by hand and, consequently, attachment of the disc-shaped tool is possible without additional tools.

Clamping of the clamping anchor by means of the known spring requires a manual actuating mechanism which is fixedly arranged on the housing on the side opposite the tool and enables a force acting against the spring to be manually applied. This type of actuation, therefore, opposes a compact design of the complete device.

The object underlying the invention is, therefore, to design the known device for attaching a disc-shaped grinding tool which does not require an auxiliary tool for releasing or tightening the tool attachment in as compact a manner as possible and, in particular, in such a way that it is hydraulically actuatable.

DISCLOSURE OF THE INVENTION

This object is achieved, in accordance with the invention, in a device of the kind described at the beginning in that the means comprises a first pressure cylinder including a first cavity between the clamping anchor and the tool spindle, a second pressure cylinder including a second cavity arranged in the clamping anchor or the tool spindle and a connecting channel between the two cavities, in that the second pressure cylinder includes a piston arranged in the second cavity, and in that in order to effect the clamping, the piston is adjustable and fixable in its position in which it clamps the tool by the manual actuating mechanism from a tool end of the tool spindle.

A clamping device is known from German Utility Model 69 18 532 for clamping a tool arranged on a machine part by cooperation of a first and a second pressure cylinder and also an actuating device. However, this clamping device is always arranged such that the tool is positioned between the clamping device itself and the machine part, i.e., for example, the tool spindle. Therefore, the entire clamping device is arranged opposite the tool spindle with respect to the tool and sits directly on the tool and can, consequently, press the tool against the tool spindle.

Hence the German Utility Model 69 18 532 cannot anticipate the special design of the tool spindle and the clamping anchor guided therein and also the arrangement of the two pressure cylinders within the tool spindle with an axial recess, as is the subject of the present invention.

Accordingly, the gist of the invention is that both pressure cylinders are arranged in the tool spindle which is necessary in any case, that both pressure cylinders are actuatable from a tool end of the tool spindle, that both in the position clamping the tool and in the position not clamping the tool, both pressure cylinders communicate with one another and correspond with one another, and that during the clamping, the actuatable piston of the second pressure cylinder acts upon a pressure medium arranged in both pressure cylinders and in the connecting channel and the pressure medium in the second pressure cylinder causes the clamping anchor to move from its position in which it does not clamp the tool into its position in which it clamps the tool. A reduction ratio is preferably provided between the second and the first pressure cylinders, i.e., a smaller force in the second pressure cylinder acting on the piston during actuation results in a larger force being exerted on the clamping anchor in the first pressure cylinder.

An embodiment wherein the first cavity is defined by delimiting surfaces of the tool spindle and the clamping anchor which face each other and are arranged in axially spaced relation to each other and by corresponding circumferential surfaces of the clamping anchor and the tool spindle is particularly preferred.

A solution which is particularly simple from a structural point of view is achieved by the delimiting surface of the clamping anchor facing the tool while the delimiting surface of the tool spindle faces away from the tool so that a volume dilatation in the first cavity results in the delimiting surface of the clamping anchor being moved away from the tool and hence the clamping anchor can carry out an axial displacement which directly clamps the tool.

Adjustment of the piston is advantageously carried out via a bore which is open at the tool end and extends in the clamping anchor or in the tool spindle as far as the piston and through which the manual actuating mechanism extends.

In the embodiments described so far, no details have been given of the mechanism by means of which the piston is to be actuated. In a preferred embodiment, the manual actuating mechanism is arranged in a region of the clamping anchor or the tool spindle at the tool end.

Operation of the inventive device is achievable in a particularly expedient manner by the manual actuating mechanism being accessible for operation from the side of the tool facing away from the tool spindle.

In particular, this manual actuating mechanism is designed so as to be operable via a retaining device which is releasably attachable to the clamping anchor for securing the clamping flange on the clamping anchor since such a releasably attachable retaining device is necessary in any case. In this way, an optimal compact design is achieved since both the entire means for pressing the clamping flange against the abutment, thereby clamping the tool between these, and the manual actuating mechanism for this means are integrated in parts which are normally necessary in such a portable machine tool in any case and, consequently, there is practically no increase in volume in the inventive solution.

The inventive manual actuating mechanism can be particularly well integrated in a portable machine tool if the manual actuating mechanism includes an adjustable clamping member which acts upon the piston in order to effect clamping.

Adjustment of the clamping member may be carried out in many different ways. It is, for example, conceivable for the clamping member to be acted upon directly by hand and to be lockable in its actuated position. Simpler operability of the clamping member which, above all, requires less force is possible if the clamping member comprises a surface oriented at an incline to a direction of adjustment of the piston. This surface may, for example, be the circumferential surface of an eccentric, via which the piston is actuatable, for example, by means of a piston rod. The inclined surface may, however, also be an abutment surface which is displaceable transversely to the direction of adjustment of the piston and likewise acts, for example, on a piston rod in order to adjust the piston.

The simplest way of implementing the inclined surface is for the clamping member to comprise a thread and for its thread surfaces to then form the inclined surfaces.

Within the scope of the manual actuating mechanism, the clamping member itself may be arranged at different locations. In one possible embodiment according to the invention, the clamping member is arranged in the clamping anchor or in the tool spindle, more particularly, in the bore extending as far as the piston.

In an alternative solution according to the invention, the clamping member is arranged on the retaining device.

In the inventive solutions described so far, no details of the arrangement of the clamping flange have been given. It is, for example, expedient for the retaining device to include the clamping flange.

To enable this clamping flange to be attached to the clamping anchor, the retaining device comprises a retaining member which is securable against axial displacement in a positively connected manner on the clamping anchor. The retaining member may be designed in many different ways. It is, for example, possible for the retaining member to be connectable to the clamping anchor in the form of a bayonet joint.

In a structural alternative, the retaining member can be screwed into the clamping anchor.

In a particularly preferred embodiment of a manual actuating mechanism, the clamping member and the retaining member are the same screw and, therefore, both attachment of the clamping flange to the clamping anchor and simultaneous actuation of the piston are effected by screwing this screw into the clamping anchor.

Herein, it is particularly advantageous for the screw to be screwable into a first and an adjoining second threaded section of the clamping anchor and for the piston to be actuatable when the screw is screwed into the second threaded section. The great advantage of such a structural solution is that the clamping flange can first be roughly secured on the clamping anchor and further tightening of the screw causes actuation of the piston which then results in final clamping of the tool.

In this embodiment, it is advantageous for the clamping flange to be held on the retaining member in such a manner that it can be turned and acted upon by the retaining member in the direction of the tool. This is necessary in order to prevent frictional forces between the tool and the screw itself from impeding rotation of the retaining member when the tool is being secured. If, however, the clamping flange held rotatably on the retaining member rests on the tool, then the retaining member can still be designed so as to be easily rotatable relative to the clamping flange even if it acts, for example, with a shoulder on the clamping flange.

The retaining member can be turned particularly easily if an axial thrust bearing is arranged between the screw and the clamping flange.

In order to prevent the clamping flange from being able to turn relative to the tool spindle, which is necessary particularly when the tool spindle of the inventive portable machine tool can be rotatably driven in opposite directions or when a braking device is provided for the tool spindle, it is advantageous for the clamping flange to be rotationally fixedly securable on the tool spindle by means of positive connection elements. For safety reasons, it is also expedient in many cases for rotation of the clamping member relative to the clamping flange to be eliminated during operation. For this reason, the clamping member is securable against rotation on the clamping flange.

The simplest form of effecting such securing is for the clamping member to be securable in a positively connected manner on the clamping flange.

Such securing by positive connection is conceivable in any chosen manner. It is, for example, possible to provide a detent means which is radially displaceable in relation to the tool spindle.

It is, however, particularly expedient for the clamping member to be securable by a securing element which is displaceable in the axial direction and which may, for example, be a bolt which engages bores in both the clamping member and the clamping flange.

With such a variant, however, securing would only be possible in certain relative positions between clamping member and clamping flange. For this reason, provision is expediently made within the scope of the above embodiment for the securing element to be rotationally fixedly and axially displaceably held on the clamping member or on the clamping flange and to be engageable with a toothed rim of the clamping flange or the clamping member which is coaxial with their axis of rotation. Hence securing of the clamping member is possible in angular positions corresponding to an angular spacing of successive teeth of the toothed rim.

Finally, it is advantageous for the securing element to be lockable in its position in which it secures the screw.

In a further preferred embodiment as an alternative to the embodiment in which the clamping member and the retaining member are one and the same screw, the clamping member is adjustable relative to the retaining member and, in particular, variants in which the clamping member is screwable into the retaining member are conceivable.

In this embodiment, it is not necessary to turn the retaining member after the tool has been placed against the abutment for final clamping of the tool, and, therefore, in a simple embodiment it is sufficient for the clamping flange to be formed on the retaining member.

Alternatively, however, as in the embodiment described above, provision may be made for the clamping flange to be rotatable relative to the retaining member and so, in particular, with tool spindles which are rotatable in opposite directions or also braked tool spindles, the clamping flange can be rotatably fixable by positive connection on the tool spindle.

In an expedient embodiment of the present invention which is particularly simple from a structural point of view, the clamping member is a threaded spindle with an actuating element protruding beyond the retaining member and so by turning the actuating element, the threaded spindle can be screwed into a position in which it acts upon the piston to clamp the tool and can be screwed out to release it. Hence it is sufficient for the retaining member to be axially fixed in a positively connected manner on the clamping anchor and for the final clamping of the tool by means of a decrease in size of the second cavity and an increase in size of the first cavity to be brought about by screwing in the threaded spindle, as a result of which the entire clamping anchor is moved away from the tool and, consequently, the tool is clamped by the retaining member fixed on the clamping anchor and the clamping flange connected to the retaining member.

For safety reasons, it is, furthermore, advantageous for the clamping member to be rotationally fixedly securable on the retaining member by a securing element and in this case it is expedient for the clamping member to be securable in a rotationally fixed manner by positive connection.

As described above, such a securing element may be designed in different ways but within the scope of the present invention, a securing element which is displacable in the axial direction is preferred.

The simplest and most expedient securing element design is a cap which engages over the actuating element of the clamping member.

In an improved embodiment, the securing element is additionally lockable in its position in which it fixes the clamping member.

In all of the embodiments described above, details were not given of which pressure medium is to be provided in the first cavity, the second cavity and the connecting channel.

In a preferred embodiment, the first and the second cavities and also the connecting channel are filled with a plastic substance for hydraulic pressure transfer. This is, in particular, expedient because portable machine tools should be operable where large temperature differences prevail and in such instances should also function reliably. Use of a conventional hydraulic oil results in sealing problems in the pressure cylinders which can only be solved with great difficulty if at all. The advantage of the plastic substance is that it eliminates such sealing problems.

A polyvinyl chloride with a relatively low degree of polymerization is particularly preferred as plastic substance.

Alternatively, it is, however, similarly conceivable for the first cavity, the second cavity and the connecting channel to be filled with a viscous substance as this also eliminates the sealing problems referred to above. The viscous substance is preferably a silicon substance, more particularly, a silicon lubricant.

In addition, it is advantageous for the plastic or viscous substances to be compressible as these then result in an elastic clamping of the tool which adapts to different expansions of the individual parts.

However, to enable substantially incompressible pressure transfer media to also be used in the inventive solution, a variant of the solution according to the invention features an elastic element which permits axial displacement of the clamping flange relative to the tool spindle. This element may be arranged at very different locations. It is, for example, conceivable for this element to be arranged between the clamping flange and the retaining member which acts upon it.

This elastic element is preferably of such dimensions that it is compressible up to inelasticity while the tool is being clamped. In this way, an even larger path is achievable in the clamping procedure and, in addition, when incomplete clamping of the tool has been effected with the inventive device, this elastic element ensures that the tool still rotates with the tool spindle, which prevents all kinds of accidents owing to faulty clamping.

In a particularly simple embodiment, the elastic element is a volume-elastic element arranged in one of the cavities so that the volume-elastic element is first compressed and the final clamping of the tool is then effected by the volume compression.

Further features and advantages of the invention are the subject of the following description and the appended drawings of several embodiments.

DETAILED DESCRIPTION OF THE INVENTION

Figure 1:
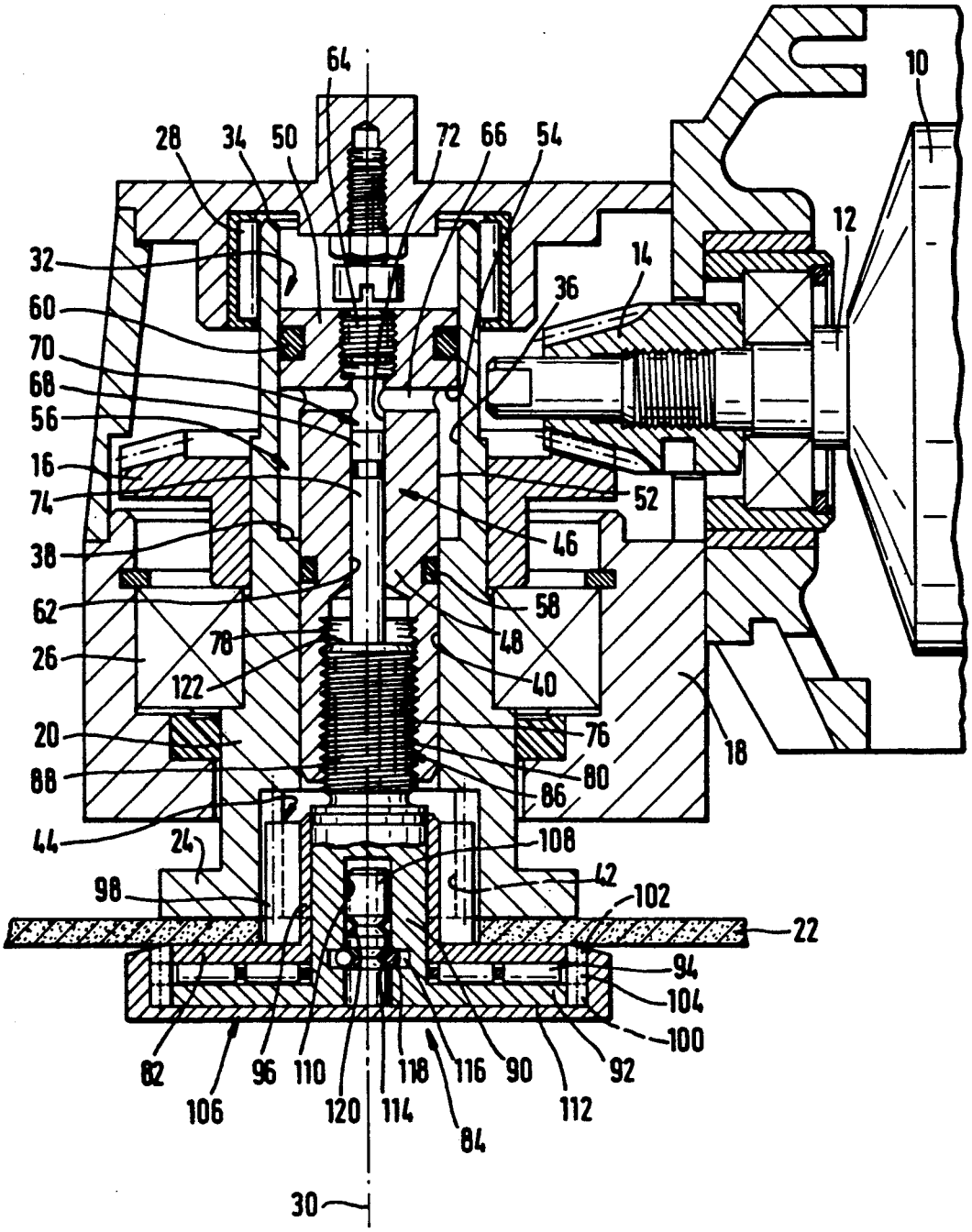
FIG. 1 is a sectional view of a first embodiment of the invention.

A first embodiment of an inventive angle grinder, illustrated in FIG. 1, comprises a drive motor 10, partly illustrated in the drawing, with a drive shaft 12 which via a drive pinion 14 drives a bevel gear 16 of a tool spindle 20 which is rotatably mounted in a gear housing 18. This tool spindle 20 comprises at one end a flange 24 serving as abutment for a tool, in particular, a grinding disc 22. The tool spindle 20 is supported in the gear housing 18 on one side facing the flange 24 by means of a bottom bearing 26 and on a side facing away from the flange 24 by means of a top bearing 28 arranged in spaced relation to the bottom bearing 26. Hence the tool spindle 20 is rotatable about an axis 30.

The tool spindle 20 in the form of a hollow spindle comprises a coaxial central recess 32 which with a widened section 36 extends into the tool spindle 20 from an end 34 located opposite to the flange 24 and hence to the tool 22, passes via a stepped surface 38 into a central section 40 of smaller diameter than the widened section 36 and following the central section 40 widens in the region of the flange 24 to a toothed section 44 which is provided with an internal toothing 42 and is open towards the tool 22.

A clamping anchor 46 is axially displaceably but rotationally fixedly mounted in this tool spindle 20. The clamping anchor 46 comprises a center part 48 which is guided in the central section 40 of the coaxial recess 32 and carries on its end facing away from the tool 22 a clamping anchor head 50 which is of larger diameter than the center part 48 and is guided in the widened section 36.

This clamping anchor head 50 comprises on its side facing the stepped surface 38 an annular surface 54 extending as far as a circumferential surface 52 of the center part 48 and delimiting together with the circumferential surface 52 of the center part 48, the stepped surface 38 and the widened section 36 of the coaxial recess 32 a first cavity 56 of a first pressure cylinder formed by the tool spindle 20 and the clamping anchor 46 slidingly displaceable therein. To enable perfect operation of this first pressure cylinder, the center part 48 is provided with an annular seal 58 which is effective relative to the central section 40 of the coaxial recess and the clamping anchor head 50 is provided with an annular seal 60 which is effective relative to the widened section 36.

The clamping anchor 46 itself is provided with a central bore 62 which extends through the clamping anchor 46 from the clamping anchor head 50 end and into which a sealing screw 64 is screwed in the region of the clamping anchor head 50. Connecting channels 66 arranged in a region of the center part 48 facing the clamping anchor head 50 extend from this central bore 62 in a radial direction to the first cavity 56.

A piston 68 is sealingly guided in the central bore 62 on the tool side of these connecting channels 66. The piston 68 defines a second cavity 70 which is delimited, on the one hand, by the piston 68 and, on the other hand, by the sealing screw 64 and by a bore section 72 of the central bore 62 located between these two.

The piston 68 itself is acted upon from its side facing the tool 22 by a piston rod 74 which extends away from the piston 68 through the central bore 62 in the direction of the tool 22.

Towards the tool 22, the clamping anchor 46 is provided with a threaded bore 76 into which the central bore 62 extending from the clamping anchor head 50 passes, the threaded bore 76 being of larger diameter than the central bore 62.

The piston rod 74 is of such dimensions that it protrudes out of the central bore 62 into a second threaded section 78 of the threaded bore 76 adjoining the central bore 62. This second threaded section 78 is followed in the axial direction towards the tool 22 by a first threaded section 80 of the threaded bore 76.

The tool, i.e., in this case, the grinding disc 22 is held by means of a clamping flange 82 which is part of a retaining device designated in its entirety 84. This retaining device 84 comprises a retaining screw 86 which by means of a threaded bolt 88 can be screwed into the threaded bore 76 from the tool 22 end. This threaded bolt 88 of the retaining device 84 is adjoined by a cylindrical piece 90 which carries on its end located opposite to the threaded bolt 88 a circular disc-shaped screw head 92 which extends substantially parallel to the flange 24 and has a diameter which is approximately comparable therewith. This screw head 92 acts via an axial thrust bearing 94 arranged on its side facing the flange 24 upon the clamping flange 82 which in order to hold the grinding disc 22 clamps the latter between itself and the flange 24 designed as abutment.

A sleeve 96 surrounding the cylindrical piece 90 is formed on the clamping flange 82 and rotatably mounted on the cylindrical piece 90. This sleeve 96 carries an external toothing 98 which can be brought into engagement with the internal toothing 42 of the toothed section 44 of the coaxial recess 32. Hence the sleeve 96 is axially displaceable into the toothed section 44 but held therein in a rotationally fixed manner relative to the tool spindle 20.

In the embodiment illustrated in FIG. 1, both the screw head 92 and the clamping flange 82 have the same diameter and both are provided on their radially outward surfaces with respect to the axis 30 with a toothing 100 and 102, respectively, both of which are of identical design. The two toothings 100, 102 preferably have teeth arranged at an angular spacing of approximately 5 degrees. An internal toothed rim 104 of a cap 106 can be brought into engagement with these teeth. The cap 106 engages over the screw head 92 on its end face 112 facing away from the tool 22 and over both the screw head 92 and the clamping flange 82 in the region of their radially outward toothings 100 and 102, respectively.

This cap 106 is mounted by means of a pin 108 on the retaining screw 86 by this pin 108 engaging an internal bore 110 extending from the end face 112 into the retaining screw 86. The entire cap is thereby displaceable in the direction of axis 30 by the pin 108 guided in the internal bore 110 and so the internal toothed rim 104 is in engagement either with the toothing 100 of the screw head 92 only or with both the toothing 100 of the screw head 92 and the toothing 102 of the clamping flange 82.

To enable the cap 106 to be locked in its position in which it engages both toothings 100 and 102, the pin 108 is provided with a first annular groove 114 in which a retaining ring 118 mounted in a circumferential groove 116 of the internal bore 110 engages when both toothings 100 and 102 are in engagement with the internal toothed rim 104. The pin 108 is additionally provided with a second annular groove 120 in which the retaining ring 118 engages when the internal toothed rim 104 is in engagement with the toothing 100 only.

The embodiment according to the invention shown in FIG. 1 operates as follows:

In order to mount the grinding disc 22, the entire retaining device 84 is removed by screwing the threaded bolt 88 out of the threaded bore 76. A new grinding disc 22 can then be placed on the flange 24.

The retaining device 84 is then inserted by the sleeve 96 formed on the clamping flange 82 being turned in such a way that its external toothing 98 comes into engagement with the internal toothing 42 of the toothed section 44 of the coaxial recess 32. This sleeve 96 thus ensures that the clamping flange 82 itself is rotationally fixedly connected with the tool spindle 20. With the cap in engagement with the toothing 100 only, the retaining screw 86 is then screwed with its threaded bolt 88 into the threaded bore 76 of the clamping anchor 46. The threaded bolt 88 is first screwed into the first threaded section 80 and subsequently reaches the adjoining second threaded section 78. Once the threaded bolt 88 reaches this second threaded section 78, it acts with its front surface 122 upon the end of the piston rod 74 facing the front surface 122 and hence via the piston rod 74 also upon the piston 68. In the inventive solution, this is the case when the retaining screw 86 with the threaded bolt 88 has been screwed in so far that the clamping flange 82 rests on the grinding disc 22 and also brings it into abutment with the flange 24, the clamping flange 82 being acted upon by the screw head 92 via the axial thrust bearing 94. If the clamping flange 82 already rests against the grinding disc 22 before the front surface 122 has come into contact with the piston rod 74, then the clamping anchor 46 is pulled in the direction of the tool 22 until the motion of the clamping anchor 46 itself and the displacement of pressure transfer medium from the first cavity 56 to the second cavity 70 via the piston 68 have brought the piston rod 74 into contact with the front surface 122. The reverse procedure occurs when the front surface 122 rests against the piston rod 74 before the clamping flange 82 brings the grinding disc 22 into abutment with the flange 24.

If the retaining screw 86 is screwed further from this point on, then, on the one hand, the threaded bolt 88 draws by virtue of engagement in the threaded bore 76 the entire clamping anchor 46 in the direction of the flange 24 and so the first cavity 56 of the first pressure cylinder is reduced in size as the annular surface 54 and the stepped surface 38 are moved towards each other. At the same time, however, the front surface 122 presses the piston 68 in the direction of the clamping anchor head 50 via the piston rod 74 and so the second cavity 70 is similarly decreased in size.

In an advantageous embodiment, the first cavity 56, the second cavity 70 and also the connecting channels 66 are filled with a plastic substance, preferably a polyvinyl chloride with a relatively low degree of polymerization. This plastic substance is subjected to pressure by the decrease in size of the first cavity 56 and the simultaneous decrease in size of the second cavity 70 as the retaining screw 86 is screwed further in, and so this plastic substance attempts to move the clamping anchor 46 in its entirety away from the flange 24 and thereby exerts an additional axial pulling force on the retaining screw 86 and so the latter presses the grinding disc 22 firmly against the flange 24 via the axial thrust bearing 94 and the clamping flange 82 and hence clamps the grinding disc with the necessary force between clamping flange 82 and flange 24.

The advantageous effect of the two cooperating pressure cylinders is to be seen in the fact that when the threaded bolt 88 begins to act with its front surface 122 on the piston rod 74, a slight turning of the retaining screw 86 reduces both the first cavity 56 and the second cavity 70 in size and thus prestresses the plastic substance with high forces and, in addition, the transmission ratio between the effect of the piston 68 with a small piston surface and the annular surfaces 54 and 38 acting as large piston surfaces is effective. The plastic substance also has a certain elasticity and hence serves as elastic element which is volume-compressible within certain limits and thereby allows the grinding disc 22 to be held clamped when the retaining screw 86 is in the tightened state.

In addition to this, while the machine is running, the tool spindle 20 and hence also the plastic substance warm up and the latter then expands and, consequently, increases the force on the clamping anchor 46. To enable the tightened state of the retaining screw 86 to be fixed during operation of the inventive angle grinder, the cap 106 is tightened and subsequently displaced so far in the axial direction that its internal toothed rim 104 also engages the toothing 102 so that the screw head 92 is no longer able to rotate relative to the clamping flange 82. The clamping flange 82, in turn, is rotationally fixedly held on the tool spindle 20 by engagement of the external toothing 98 with the internal toothing 42 of the tool spindle 20 and, therefore, in all, rotation of the screw head 92 relative to the tool spindle 20 is no longer possible.

Figure 2:
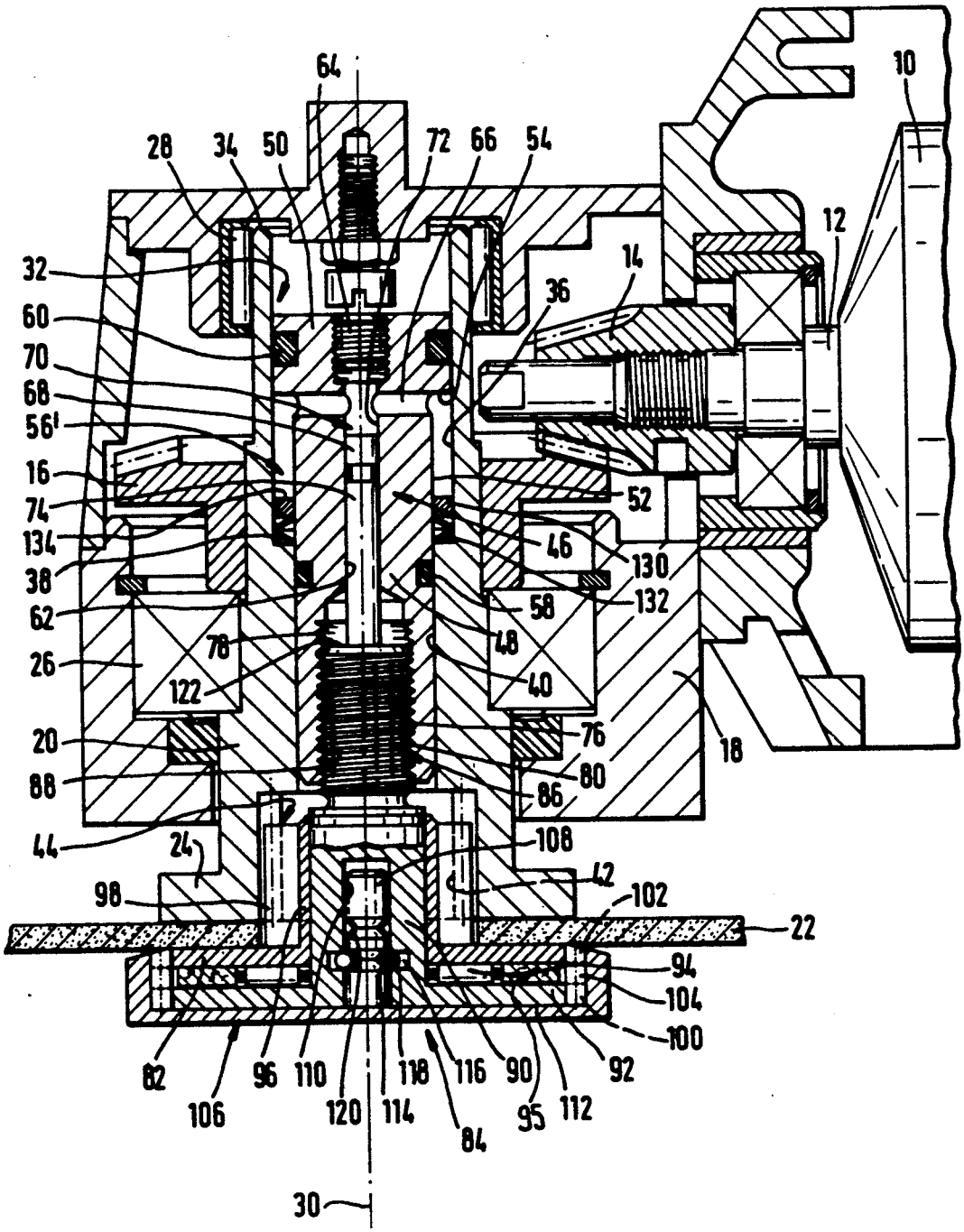
FIG. 2 is a section similar to FIG. 1 through a second embodiment.

In a second embodiment of the inventive solution, illustrated in FIG. 2, insofar as the same parts are used as in the first embodiment, these bear the same reference numerals and, therefore, reference is made to the first embodiment for a description of these.

In contrast with the first embodiment of the inventive angle grinder, a piston ring 130 extending between the widened section 36 of the coaxial recess 32 and the circumferential surface 52 of the center part 48 is provided at a distance from the stepped surface 38. The piston ring 130 acts as a seal between these two surfaces and is supported by means of Belleville washers 132 on the stepped surface 38. Consequently, the first cavity 56' of the second embodiment is not delimited by the stepped surface 38 but by a piston ring surface 134 facing the annular surface 54.

The purpose of the Belleville washers 132 is to act as additional elastic element when the retaining screw 86 is tightened so that when the threaded bolt 88 acts with its front surface 122 upon the piston rod 74, further turning through a considerable angle is still possible because tightening of the retaining screw 86 is not delimited by the elasticity of the plastic substance but instead upon further tightening, the Belleville washers 132 are first compressed until the piston ring 130 is supported by the stepped surface 38 via the compressed Belleville washers 132. Only after that does slight compression of the plastic substance arranged in the first cavity 56', the second cavity 70 and the connecting channels 66 occur in order to achieve final clamping of the grinding disc 22.

In addition, the axial thrust bearing 94 is sealed off against soiling by a felt ring 95 surrounding it.

Figure 3:
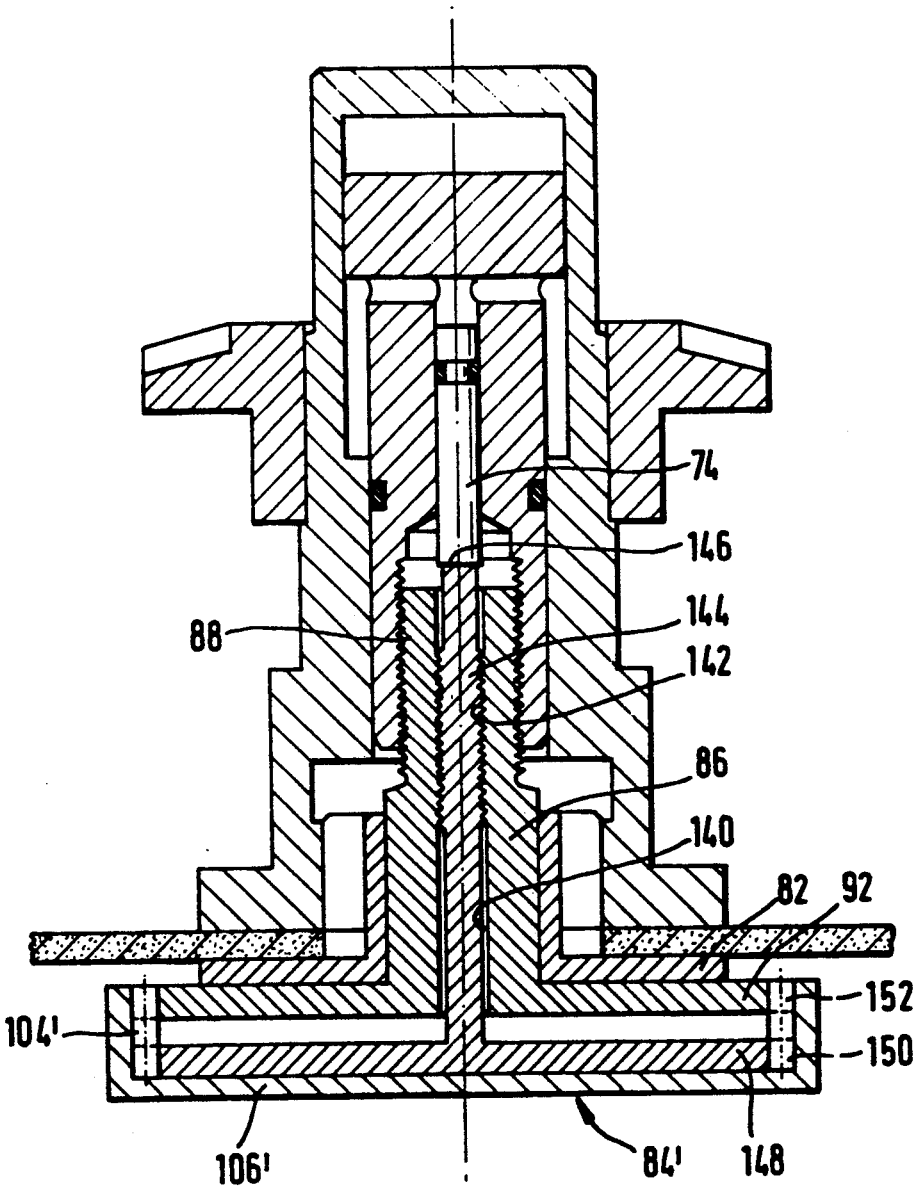
FIG. 3 is a section similar to FIG. 1 through tool spindle, clamping anchor and retaining device of a third embodiment.

In a third embodiment of the inventive device, illustrated in FIG. 3, insofar as the same parts are used, these bear the same reference numerals and, therefore, reference is made to the first embodiment for a description of these.

In contrast with the first and second embodiments, the retaining screw 86 in the third embodiment does not press with its front surface 122 on the piston rod 74. Instead, the retaining screw is provided with an axial bore 140 which extends through it and has an internal thread 142. A threaded spindle 144 which extends through the entire axial bore 140 and acts upon the piston rod 74 with its end 146 facing the piston rod 74 can be screwed into this internal thread 142. The threaded spindle 144 is provided with an actuating wheel 148 which is arranged on a side of the screw head 92 located opposite the clamping flange 82. By turning the actuating wheel 148, the threaded spindle 144 can be screwed into the internal thread 142 until the actuating wheel 148 rests against the screw head 92. On the other hand, the spacing of the actuating wheel from the screw head 92 can be increased by screwing the threaded spindle 144 out of the internal thread 142.

In addition, the actuating wheel is covered by a cap 106' which has an internal toothed rim 104' which can be brought into engagement with both a radially outward toothing 150 of the actuating wheel 148 and a radially outward toothing 152 of the screw head 92, but by axial displacement of the cap 106' away from the actuating wheel 148 is only in engagement with the toothing 150 so that the actuating wheel 148 is freely rotatable relative to the screw head 92.

In the third embodiment, the grinding disc 22 is secured in the following way: First the threaded spindle 144 is screwed out so that the actuating wheel 148 is spaced from the screw head 92. The screw 86 with the threaded bolt 88 is then screwed into the threaded bore 76 until the clamping flange 82 brings the grinding disc 22 into abutment with the flange 24 and, in addition, the end 146 of the threaded spindle 144 rests against the piston rod 74 and begins to act upon it.

In this state, the screw 86 itself is not screwed further, but only the actuating wheel 148 is turned so that the threaded spindle 144 is screwed into the internal thread and its end 146 presses the piston rod 74 and the piston 68 in the direction of the clamping anchor head 50. The second cavity 70 is thereby reduced in size and the displaced plastic substance attempts to expand in the first cavity 56, which results in slight displacement of the entire clamping anchor 46 away from the flange 24 and hence in movement of the entire screw 86 with the clamping flange 82 in the direction towards the flange 24, whereby the grinding disc 22 is firmly clamped. The actuating wheel 148 is preferably screwed in until it comes to rest against the screw head 92.

In the above-described clamping within the scope of the third embodiment, in particular, the transmission ratio between the piston surface of the piston 68 and the annular surface 54 and also the stepped surface 38 is effective. This is preferably chosen in the order of magnitude of 1:10 so that the screwing-in of the actuating wheel 148 with the threaded spindle 144 results in ten times the clamping force at the screw head 92 and hence at the clamping flange 82.

In this screwed-in state, the actuating wheel 148 can, in turn, be secured in a rotationally fixed manner on the screw head 92 itself by displacement of the cap 106' in the direction of the screw head 92 and so loosening of the actuating wheel is prevented during operation of such an angle grinder.

In this third embodiment, the recess 32 of the tool spindle 20 is advantageously closed at the end 34.

The present disclosure relates to the subject matter disclosed in German Application No. P 38 00 437.2 of Jan. 9, 1988, the entire specification of which is incorporated herein by reference.

What is claimed is:

1. Device for clamping a disc-shaped tool on a motor-driven tool spindle of a portable machine, tool comprising:

a grinding disc on an angle grinder;

a clamping anchor arranged in said tool spindle which has an axial recess, said clamping anchor being axially displaceable relative to said tool spindle and rotationally fixedly connected to said tool spindle;

a clamping flange releasably attachable to the free end of said clamping anchor;

an abutment arranged at the tool end of the tool spindle;

means actuatable by a manual actuating mechanism operable tool-free for releasably pressing said clamping flange against said abutment, thereby clamping said tool between these said means for releasably for releasably pressing comprising:

a first pressure cylinder including a first cavity (56) between said clamping anchor (46) and said tool spindle (20);

a second pressure cylinder including a second cavity (70) arranged in said clamping anchor (46) or said tool spindle (20); and a connecting channel (66) between said two cavities (56, 70);

said second pressure cylinder including a piston (68) delimiting said second cavity (70), and in order to releasably clamp said tool (22), said piston (68) being adjustable and fixable in its position in which it clamps said tool (22) by said manual actuating mechanism from a tool end of said tool spindle (20);

said first cavity (56) defined by delimiting surfaces (38, 54) of said tool spindle (20) and said clamping anchor (46), with said delimiting surfaces facing one another and being arranged in axially spaced relation to one another;

said manual actuating mechanism being operable via a retaining device (84) for securing said clamping flange (82) on said clamping anchor (46);

said retaining device being releasably attachable to said clamping anchor (46);

said manual actuating mechanism comprising an adjustable clamping member (86, 144) acting upon said piston (68) in order to effect clamping;

said clamping member (86, 144) being arranged on said retaining device (84); and said retaining device including:

a clamping member (86) which is securable against axial displacement in a positively connected manner on said clamping anchor (46); and said clamping member (86) being securable by a securing element (106) which is displaceable in the axial direction.

2. Device as defined in claim 1, characterized in that said first cavity (56) is defined by delimiting surfaces (38, 54) of said tool spindle (20) and said clamping anchor (46), with said delimiting surfaces facing one another and being arranged in axially spaced relation to one another.

3. Device as defined in claim 2, characterized in that said delimiting surface (54) of said clamping anchor (46) faces said tool (22) whereas said delimiting surface (38) of said tool spindle (20) faces away from said tool (22).

4. Device as defined in claim 1, characterized in that adjustment of said piston (68) is carried out via a bore (62) which is open at the tool end and extends in said clamping anchor (46) or in said tool spindle (20) as far as said piston and through which said manual actuating mechanism extends.

5. Device as defined in claim 4, characterized in that said manual actuating mechanism is accessible for operation from the side of said tool (22) facing away from said tool spindle (20).

6. Device as defined in claim 1, characterized in that said manual actuating mechanism is arranged in a tool end region of said clamping anchor (46) or said tool spindle (20).

7. Device as defined in claim 1, characterized in that said manual actuating mechanism comprises an adjustable clamping member (86, 144) which acts upon said piston (68) in order to effect clamping.

8. Device as defined in claim 7, characterized in that said clamping member (86, 144) comprises a surface which is oriented at an incline to a direction of adjustment of said piston (68).

9. Device as defined in claim 7, characterized in that said clamping member (86, 144) comprises a thread.

10. Device as defined in claim 7, characterized in that said manual actuating mechanism is operable via a retaining device (84) for securing said clamping flange (82) on said clamping anchor (46), said retaining device being releasably attachable to said clamping anchor (46), and further characterized in that said clamping member (86, 144) is arranged on said retaining device (84).

11. Device as defined in claim 7, characterized in that said manual actuating mechanism is operable via a retaining device (84) for securing said clamping flange (82) on said clamping anchor (46), said retaining device being releasably attachable to said clamping anchor (46), further characterized in that said retaining device (84) includes a retaining member (86) which is securable against axial displacement in a positively connected manner on said clamping anchor (46), said clamping member (144) is adjustable relative to said retaining member (86).

12. Device as defined in claim 11, characterized in that said clamping member (144) can be screwed into said retaining member (86).

13. Device as defined in claim 11, characterized in that said clamping member is a threaded spindle (144) with an actuating element (148) which protrudes beyond said retaining member (86).

14. Device as defined in claim 11, characterized in that said clamping member (144) is rotationally fixedly securable on said retaining member (86) by a securing element (106').

15. Device as defined in claim 1, characterized in that said retaining device (84) includes said clamping flange (82).

16. Device as defined in claim 1, characterized in that said retaining member (86) can be screwed into said clamping anchor (46).

17. Device as defined in claim 16, characterized in that said manual actuating mechanism comprises an adjustable clamping member (86, 144) which acts upon said piston (68) in order to effect clamping, and further characterized in that said clamping member and said retaining member are the same screw (86).

18. Device as defined in claim 17, characterized in that said screw (86) can be screwed into a first (80) and an adjoining second threaded section (78) of said clamping anchor (46), and in that said piston (68) is actuatable during the screwing into said second threaded section (78).

19. Device as defined in claim 1, characterized in that said clamping flange (82) is held in a rotatable manner on said retaining member (86) and in such a way that it can be acted upon by said retaining member in the direction of said tool (22).

20. Device as defined in claim 19, characterized in that an axial thrust bearing (94) is arranged between said retaining member (86) and said clamping flange (82).

21. Device as defined in claim 19, characterized in that said clamping flange (82) is rotationally fixedly securable on said tool spindle (20) by positive connection elements (42, 98).

22. Device as defined in claim 1, characterized in that said clamping member (86) is securable in a positively connected manner on said clamping flange (82).

23. Device as defined in claim 1, characterized in that said first and said second cavities (56, 70) and also said connecting channel (66) are filled with a plastic substance for hydraulic pressure transfer.

24. Device as defined in claim 23, characterized in that said plastic substance is polyvinyl chloride with a relatively low degree of polymerization.

25. Device as defined in claim 1, characterized in that said first cavity (56), said second cavity (70) and said connecting channel (66) are filled with a viscous substance.

26. Device as defined in claim 25, characterized in that said viscous substance is a silicon substance, in particular, a silicon lubricant.

27. Device as defined in claim 1, characterized in that an elastic element (130, 132) permitting axial displacement of said clamping flange (82) relative to said tool spindle (20) is provided.

28. Device as defined in claim 27, characterized in that said elastic element (130, 132) is compressible up to inelasticity during clamping of said tool (22).

29. Device as defined in claim 27, characterized in that said elastic element is a volume-elastic element (130, 132) arranged in one of said cavities (56).

30. Device as defined in claim 1, characterized in that said securing element (106) is rotationally fixedly and axially displaceably held on said clamping member (86) or on said clamping flange (82) and can be brought into engagement with a toothed rim of said clamping flange (102) or of said clamping member (100), said toothed rim being coaxial with their axis of rotation (30).

31. Device as defined in claim 1, characterized in that said clamping member (86) is securable by a securing element (106) which is displaceable in the axial direction, and further characterized in that said securing element (106) is lockable in its position in which it secures said clamping member (86).

* * * * *